United States Patent [19]

Henderson

[11] 4,387,378

[45] Jun. 7, 1983

[54] ANTENNA HAVING ELECTRICALLY POSITIONABLE PHASE CENTER

[75] Inventor: Albert S. Henderson, Melbourne, Fla.

[73] Assignee: Harris Corporation, Melbourne, Fla.

[21] Appl. No.: 271,951

[22] Filed: Jun. 9, 1981

Related U.S. Application Data

[63] Continuation-in-part of Ser. No. 920,133, Jun. 28, 1978, abandoned.

[51] Int. Cl.[3] ..... H01Q 3/26

[52] U.S. Cl. ..... 343/854; 343/833; 343/786

[58] Field of Search ..... 343/833–837, 343/761, 818, 819, 839, 854, 786, 776, 777, 778, 772

[56] References Cited

U.S. PATENT DOCUMENTS

| | | | |
|---|---|---|---|
| 3,274,590 | 9/1966 | Page | 343/854 |
| 3,277,490 | 10/1966 | Williams | 343/833 |
| 3,324,472 | 6/1967 | Sundberg et al. | 343/854 |
| 3,560,978 | 2/1971 | Himmel et al. | 343/833 |
| 3,725,938 | 4/1973 | Black et al. | 343/833 |
| 3,846,799 | 11/1974 | Gueguen | 343/833 |
| 3,935,576 | 1/1976 | Pickles | 343/833 |
| 4,260,994 | 4/1981 | Parker | 343/854 |

*Primary Examiner*—David K. Moore

*Attorney, Agent, or Firm*—Yount & Tarolli

[57] ABSTRACT

An antenna (50) is disclosed herein whose phase center may be electrically moved relative to a main receiving-/radiating element. The main receiving element (56) is located in a cavity (54) in a ground plane (52). Spaced around the main receiving element are a number of paracletic elements (58, 60, 62, 64), each of which has at least two switchable reactance states. In one state, there is little coupling between the paracletic element and the main receiving element. In another state, coupling is increased so that the phase center of the antenna shifts towards the paracletic element. A sequencer (100) supplies bias voltages to switching diodes (84, 86) to control the reactance states of the paracletic elements and thus the position of the phase center of the antenna. The antenna may be used as a tracking feed (14) for a directional lens or reflector system (12).

32 Claims, 11 Drawing Figures

ANTENNA HAVING ELECTRICALLY POSITIONABLE PHASE CENTER

This is a continuation-in-part of application Ser. No. 920,133, filed June 28, 1978, now abandoned.

BACKGROUND AND FIELD OF THE INVENTION

The present invention relates to the field of antennas, and more specifically to an antenna wherein the position of the phase center of the antenna relative to the primary radiating/receiving element is electronically controllable. The antenna is particularly useful as a tracking antenna feed.

Tracking antennas generally utilize special types of antenna feeds onto which the received electromagnetic energy is focused by highly directional lens or reflector systems. These feeds, known as tracking feeds, are structured and operated so that the received signal is modulated in phase and amplitude as a function of the position of the signal source relative to the boresight of the antenna. A tracking control circuit derives signal source position information from the received signal and points the antenna in accordance with this information.

Several different types of tracking feeds are commonly employed in this type of system. In a conical scan system, the main receiving element is located slightly off the vertex of the lens or reflector, and is physically rotated (scanned) about the vertex. As long as the signal source is located off the boresight of the antenna, the received signal will be modulated in accordance with this scanning action. Tracking information can thus be derived from the received signal.

In pseudomonopulse tracking feeds, a number of secondary receiving elements (usually four) are provided in addition to the main receiving element. The main receiving element is located at the vertex of the reflector (or lens), and the secondary elements are arrayed about it. The signals from these secondary elements are sequentially combined with the signal from the main receiving element, located at the vertex, in such a manner that again a modulated signal is derived from which tracking information can be obtained. The operation of this type of system is described more fully in the detailed description which follows.

Pseudomonopulse tracking feeds have the advantage that, unlike conical scanning tracking feeds, the feed includes no moving parts. Pseudomonopulses tracking feeds do, however, usually require at least two hybrids for signal comparison purposes, as well as a directional coupler and a scanning circuit. The resulting tracking feeds operates quite well, but is somewhat large and bulky.

SUMMARY OF THE INVENTION

An antenna is disclosed herein which includes a central receiving element and a number of variable reactances spaced around the central element. These variable reactances, which are sometimes referred to hereinafter as paracletic elements, are switchable between several reactance values. The primary purpose of these paracletic elements is to shift the phase center of antenna in dependence upon the reactance state of the element, and they are structured and positioned specifically to perform this function. The phase center of the antenna may be shifted around the central receiving element in any desired manner by electrically controlling the reactance value of the paracletic elements.

This antenna is particularly useful as a tracking feed in an antenna tracking system, since this phase center movement can be used to modulate the received signal in the same fashion as pseudomonopulse and conical scan tracking feeds, yet without their disadvantages.

It is therefore an object of the present invention to provide an antenna wherein the phase center thereof may be electronically positioned relative to a central receiving/radiating element.

It is another object of the present invention to provide a tracking feed which requires neither the mechanical elements of a conical scanning tracking feed nor the signal combining components of a pseudomonopulse tracking feed.

It is another object of the present invention to provide a tracking feed wherein the phase center of the tracking feed is electrically rotated about the receiving element to modulate the signal received by the antenna so that tracking information may be derived therefrom.

It is a more specific object of the present invention to provide an antenna/tracking feed wherein a central receiving element is provided, and where plural paracletic elements are spaced around the central receiving element and are switched between reactance states so as to electrically move the phase center of the antenna/-tracking feed in a desired manner.

It is still another object to provide an antenna/tracking feed as described above, and which can be used over several frequency bands.

In accordance with the present invention there is provided an antenna including a main radiating/receiving element for receiving or transmitting electromagnetic energy and at least one paracletic element which is positioned relative to the main radiating/receiving element. The paracletic element is switchable between at least first and second states, with the states primarily affecting the position of the phase center of the antenna with respect to the main radiating/receiving element. Control means are provided for controlling the states of the paracletic elements so as to thereby control the position of the phase center of the antenna.

Also in accordance with the present invention, this antenna is used as the tracking feed in an antenna tracking system.

BRIEF DESCRIPTION OF THE DRAWINGS

The foregoing and other objects and advantages of the present invention will become more readily apparent from the following description of a preferred embodiment, as taken in conjunction with the accompanying drawings, wherein.

DETAILED DESCRIPTION OF DRAWINGS

In the description which follows, the invention will be described largely in reference to an antenna tracking feed for a parabolic dish reflector. The invention, however, is not limited to this application but instead may be used in any application requiring an antenna having a movable phase center. With specific reference to tracking feeds, the antenna may be used as a feed for any directional lens or reflector system, whether simple or compound.

Figure 1:
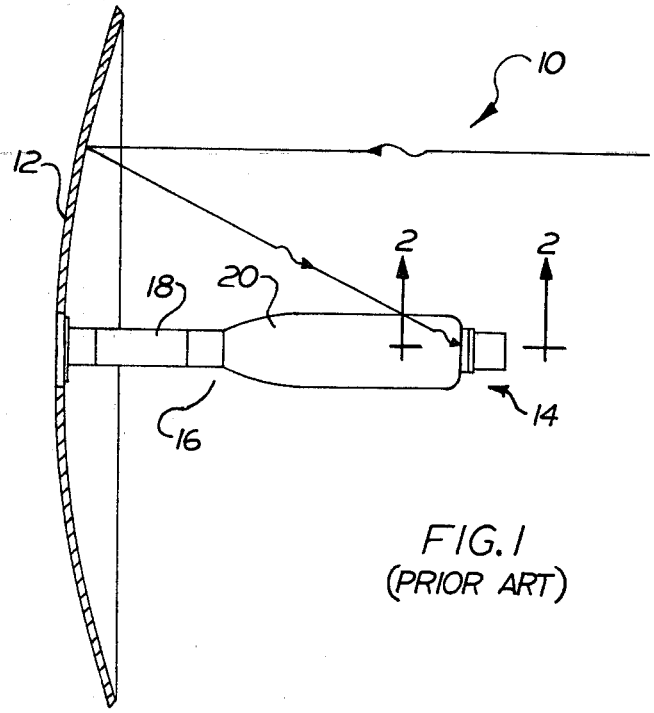
FIG. 1 (PRIOR ART)
FIG. 1 is an illustration of a parabolic antenna employing a conventional psuedomonopulse tracking feed.

There is illustrated in FIG. 1 a directional antenna 10 employing a pseudomonopulse tracking feed of conventional construction. This antenna 10 includes a parabolic dish reflector 12 having a tracking feed 14 located at the vertex thereof. This tracking feed 14 is supported at the vertex of the reflector by means of a support member 16. The support member 16 includes two sections: a tubular inner member 18, and an outer, dielectric support member 20 upon which the tracking feed is mounted. The core 22 of dielectric support member 20 is composed of polystyrene foam, and is covered on the outside thereof by a fiberglass casing 24.

Figure 2:
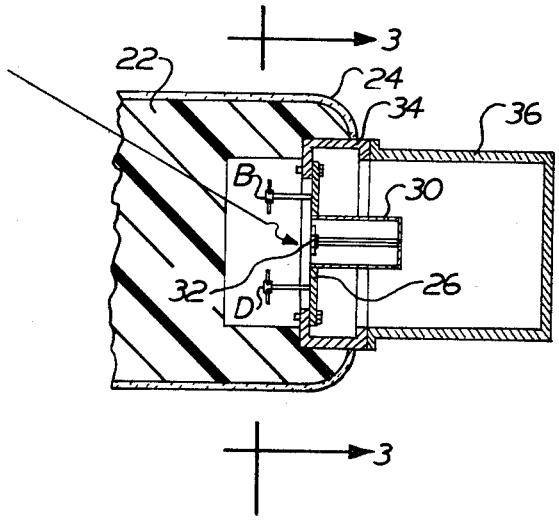
FIG. 2 (PRIOR ART)
FIG. 2 is a cross sectional illustration of the tracking feed of the antenna of FIG. 1.
Figure 3:
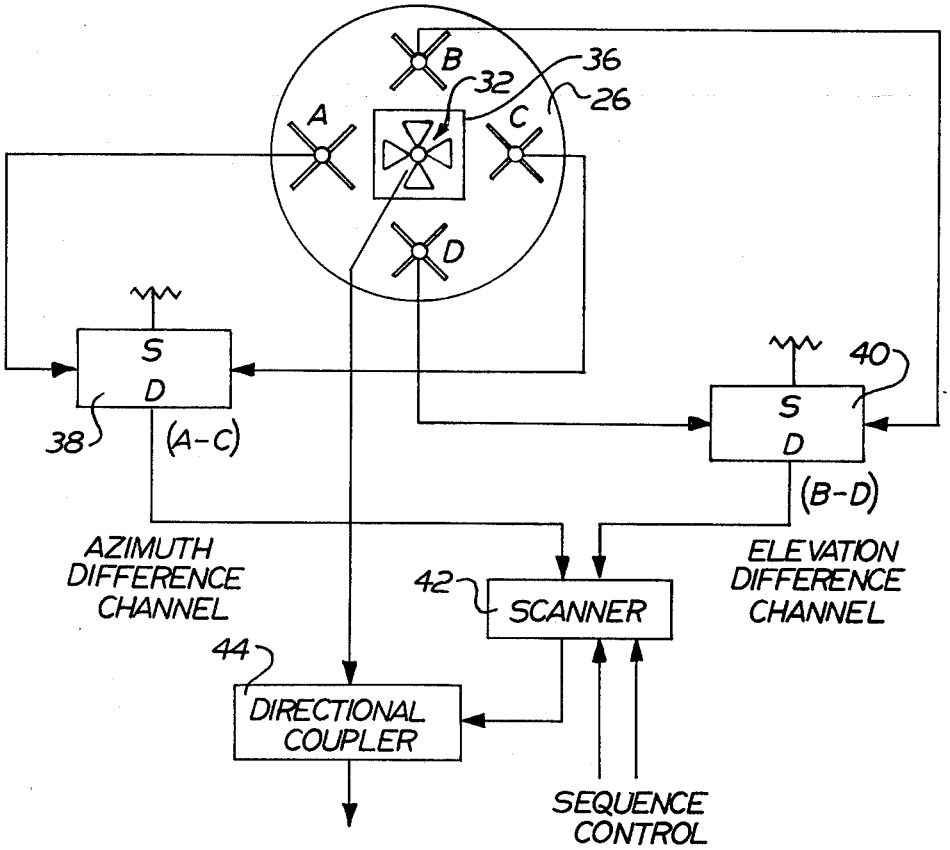
FIG. 3 (PRIOR ART)
FIG. 3 is another sectional view of the tracking feed of the antenna shown in FIG. 1, together with the signal combining circuit which must be used in conjunction therewith.

The construction of the pseudomonopulse tracking feed 14 is shown in greater detail in FIGS. 2 and 3. The pseudomonopulse feed includes a conductive ground plane 26 having a substantially square opening located at the center thereof. A metal enclosure 30, having a cross section corresponding to the square opening in ground plane 26 is connected adjacent the square opening so as to form a cavity behind the ground plane. The main receiving element 32 (in this case a pair of crossed dipoles), is mounted within this cavity, flush to the ground plane.

Four secondary receiving elements A, B, C, and D are positioned around the cavity, and are supported above the ground plane at a distance of one-quarter wave length, at the antenna operating frequency. In these figures, the secondary elements are also crossed pairs of dipoles. These secondary elements provide signals which are utilized to derive the tracking information for positioning the antenna 10.

The tracking feed, thus constructed, is attached to a flange 34 associated with the dielectric support 20. A casing 36 is provided to protect the rearward side of the tracking feed (rightward, as viewed in FIG. 2). the circuitry associated with the pseudomonopulse tracking feed (not shown in FIG. 2) will be located within the chamber defined by the metal casing 36 on the one hand and the ground plane 26 on the other hand.

This circuitry (see FIG. 3) includes two hybrids 38 and 40, a scanner 42, and a directional coupler 44. Hybrid 38 responds to the signals provided by the two azimuthal secondary receiving elements A and C, and provides a difference output (A-C). This difference signal indicates the position of the signal source with respect to the boresight along the azimuthal axis. If the antenna is positioned so that the boresight lines up with the signal source in the azimuthal direction, the output of hybrid 38 will be zero. If this is not the case, then the magnitude and phase of the signal provided in the azimuthal difference channel will indicate this fact. Similarly, hybrid 40 responds to the elevational secondary receiving elements B and D and provides an elevation different channel output (B-C). The elevation difference channel will provide an output whose magnitude and phase indicates the position of the signal source relative to the boresight in the elevational axis.

The azimuth difference channel signal and the elevation difference channel signal are both directed to the scanner 42. The scanner sequentially presents the azimuth and elevation difference channel signals to the directional coupler 44, where they are added vectorally with the signals from the main radiator. The phase relation between the difference channel signals and the signal from the main radiator gives the antenna output signal the proper characteristics to allow the signal to be used by the servo control system to keep the antenna pointed at the signal source. To this end, scanner 42 sequentially presents the azimuth and elevation difference channel signals to the directional coupler 44 in the following phase relationship:

TABLE I

| Signal | Phase |
|---|---|
| Azimuth (A-C) | 0° |
| Elevation (B-D) | 0° |
| Azimuth (A-C) | 180° |
| Elevation (B-D) | 180° |

This sequence repeats continuously. The relationship of these difference signal phases to the phase of the signal received from the main receiving element 32 is set by a length of cable connecting the main receiving element to the directional coupler 44. This cable length is selected so that, if the phase of the main received signal is taken as a zero reference, the following phase states apply:

TABLE II

| Signal | Phase of Difference Signals in Relation to main Received Signal |
|---|---|
| Azimuth | −90 |
| Elevation | −90 |
| Azimuth | +90 |
| Elevation | +90 |

The output signal from the directional coupler 44 is the result of adding these difference signals to the main received signal and is characterized by both phase and amplitude modulation. The nature of this modulation is functionally related to the position of the signal source relative to the antenna boresight. The signal supplied by directional coupler 44 will therefore contain the information necessary to determine the position of the signal source relative to the antenna boresight axis.

It will be noted that, in the conventional pseudomonopulse tracking feed which has been described, the creation of the modulated tracking signals occurs in the directional coupler. It will also be noted that hybrid circuits are necessary in the two difference channels as part of this tracking system. The invention described herein eliminates the comparator circuitry in the two difference channels (i.e., the hybrids) and the directional coupler so as to create a cheaper, more efficient, and lighter antenna feed.

An antenna/tracking feed in accordance with the present invention (see FIG. 4) has an outward appearance which is quite similar to the pseudomonopulse tracking feed illustrated in FIG. 3. Furthermore, this antenna feed may be mounted on a parabolic reflector in the same fashion illustrated in FIGS. 1 and 2 with respect to the pseudomonopulse tracking feed.

Figure 4:
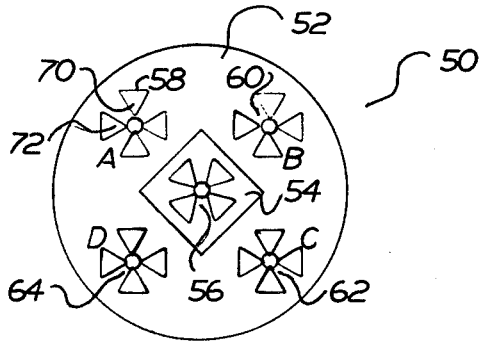
FIG. 4 is an illustration of a tracking feed in accordance with the teachings of the present invention.

As shown in FIG. 4, a tracking feed 50 in accordance with the present invention includes a ground plane 52 having a cavity 54 at the center thereof. As in the prior art, the main receiving element 56 is mounted in the cavity 54, flush to the ground plane. Four variable reactance elements 58, 60, 62 and 64 are mounted above the ground plane, equally spaced about the cavity 54.

Contrary to prior practice, variable reactance elements 58, 60, 62, and 64 do not provide separate received signals to then be combined with the main received signal. Rather, they function to influence the operating characteristics of the feed so that the main received signal will inherently be phase and amplitude modulated as a function of the position of the signal source. To this end, these elements are structured and positioned as that they interact with the radiation pattern of the main receiving element 32.

More specifically, the primary purpose of these reactance elements is to influence the position of the phase center of the tracking feed in relation to the main receiving element. Although some variation in the amplitude characteristics (i.e., the directional sensitivity of the feed, when operated in a receive mode) will necessarily result, this effect is incidental, and may be ignored for most purposes. Elements of this type (e.g., elements 58, 60, 62, and 64) will be referred to hereinafter as paracletic elements, to distinguish them from parasitic elements, in general, which may or may not influence the position of the phase center of an antenna. Thus, as the term is used herein, "paracletic element" will be understood to refer to an element whose primary purpose is to effect the position of the phase center of an antenna, rather than its amplitude (directional) characteristics.

Although the operation of the paracletic elements 58, 60, 62, and 64 does not appreciably influence the directional characteristics of the feed, the directional characteristics of the secondary pattern (i.e., the pattern of the antenna due to parabolic reflector 12) will be influenced thereby. Thus, the directional characteristic of the tracking antenna 10, viewed as a whole, will depend upon the position of the phase center, and will move as the phase center moves. Consequently, the directional characteristic of antenna 10 may be caused to scan a circle in space, centered on the boresight, by causing the phase center to rotate around the vertex of the parabolic reflector 12. This will produce the necessary modulation of the signal received by main receiving element 56.

Paracletic elements 58 through 64 will all be essentially identical, and will be configured similar to paracletic element 58, shown in greater detail in FIG. 4.

Paracletic element 58 includes two dipoles 70 and 72 which are located in a common plane, with their centers coincident and their long dimensions orthogonal. Since dipoles 70 and 72 are configured and driven identically, only the construction and operation of dipole 70 will be described in detail.

Dipole 70 comprises two dipole arms 74 and 76 comprised of triangularly shaped pieces of metal. The dipole arms 74 and 76 may, of course, instead have any number of other shapes, but this shape is presently preferred since it allows operation of the feed over a relatively wide band of frequencies. The total length L of the dipole must be carefully selected in order to provide the proper level of reactance. In prior pseudomonopulse systems, the secondary receiving elements were generally selected to be approximately 0.5 wavelengths long. Dipoles of this wavelength are unacceptable for use as paracletic elements, however, since their level of reactance is too low. If these elements are to properly operate as paracletic elements, this level of reactance must be increased. In order to provide the dipole with a capacitive reactance characteristic, the dipole length L should be selected to be less than 0.5 wavelengths, and will generally be somewhat less than 0.35 wavelengths (at the center frequency of the highest frequency band of interest). Alternatively, the dipole length L may be selected to somewhat greater than 0.5 wavelengths, in which case the element will exhibit an inductive impedance. In either event, the dipole will be useful as a paracletic element.

Dipole arms 74 and 76 are each supported above the ground plane 70 by corresponding support member 78 and 80. These support members are electrically conductive and are fixed to the ground plane by insulated connections (not shown). The dipole arms are supported above the ground plane at a height of one-quarter of the wavelength at the center frequency of operation of the antenna ($F_c$). If the antenna is to be operated in two frequency bands, this $F_c$ will represent the center frequency between the two bands.

A capacitor 82 joins support members 78 and 80 at a specific distance from the dipole arms 74 and 76. As is brought out more fully below, the purpose of capacitor 82 is to provide an effective RF short between support members 78 and 80 at a one-quarter wavelength distance from the dipole arms. Support members 78 and 80 thus act as a quarter wavelength stub, and provide a high impedance load to the dipole 70. Also connecting the dipole arms 74 and 76 are two diodes 84 and 86 which are located at specified distances from the capacitor 82.

If diodes 84 and 86 are both in their "off" or high impedance states, then dipole arms 74 and 76 will appear as two separate pieces of metal joined by a high impedance quarter wavelength stub, and will represent a high capacitive reactance. If either of diodes 84 or 86 is in the "on", or low impedance state, however, the two dipole arms will be effectively shorted together, and will provide the appearance of a single piece of metal. The reactance is then much lower than if the diodes were in their "off" condition. The capacitive reactance value of dipole 70 may thus be controlled by applying appropriate bias voltages across the support members 78 and 80. Support member 78 is connected through a dropping resistor 88 to a bias control line $S_1$, whereas support member 80 is connected to a bias ground line. As stated previously, dipole 72 is constructed identically to dipole 70. The diode bias control lines of dipole 72 will be connected in parallel with the diode bias control lines of dipole 70 so that a single control line $S_1$ controls the impedance level of both dipole 70 and dipole 72. The reactive impedance level of the entire paracletic element 58 may therefore be controlled by applying appropriate bias control voltages to bias control line $S_1$.

The position of the phase center of the tracking feed will depend upon the amount of coupling between the paracletic element and the main receiving element. This, in turn, depends upon the level of reactance of the paracletic element: the lower the reactance, the greater the coupling between the paracletic element and the main receiving element. The paracletic element will thus have little influence on the main receiving element when the diodes are "off", since the reactance of the paracletic element will be quite high at that time. When one of the diodes is "on", however, the coupling between the paracletic element will increase, and the phase center of the feed will shift towards the paracletic element. The position of the phase center of the antenna may thus be electrically controlled by applying an appropriate bias voltage to the bias line $S_1$.

The purpose of providing two diodes 84 and 86 is to allow convenient operation of the antenna in several different frequency bands. If operation in only a single frequency band is desired, then only diode 84 will be included. Diode 84 will then be spaced from capacitor 82 by a distance corresponding to one quarter of the wavelength at the center frequency of that frequency band. In this case, then, capacitor 82 will be located essentially at the ground plane (since in this case $F_c$ is equal to $F_L$).

The paracletic element thus constructed (with only diode 84) will provide operation over a relatively broad frequency range, however, the amount of modulation of the output signal for a given angular displacement of the signal source from the boresight (i.e., the error modulation slope) will vary with frequency. This effect may be compensated for at a later stage in the tracking apparatus. In some circumstances, however, it will be desirable to configure the paracletic elements so that the error modulation slope is essentially the same in several different frequency bands. It is for this purpose that the second diode 86 is included.

Figure 5:
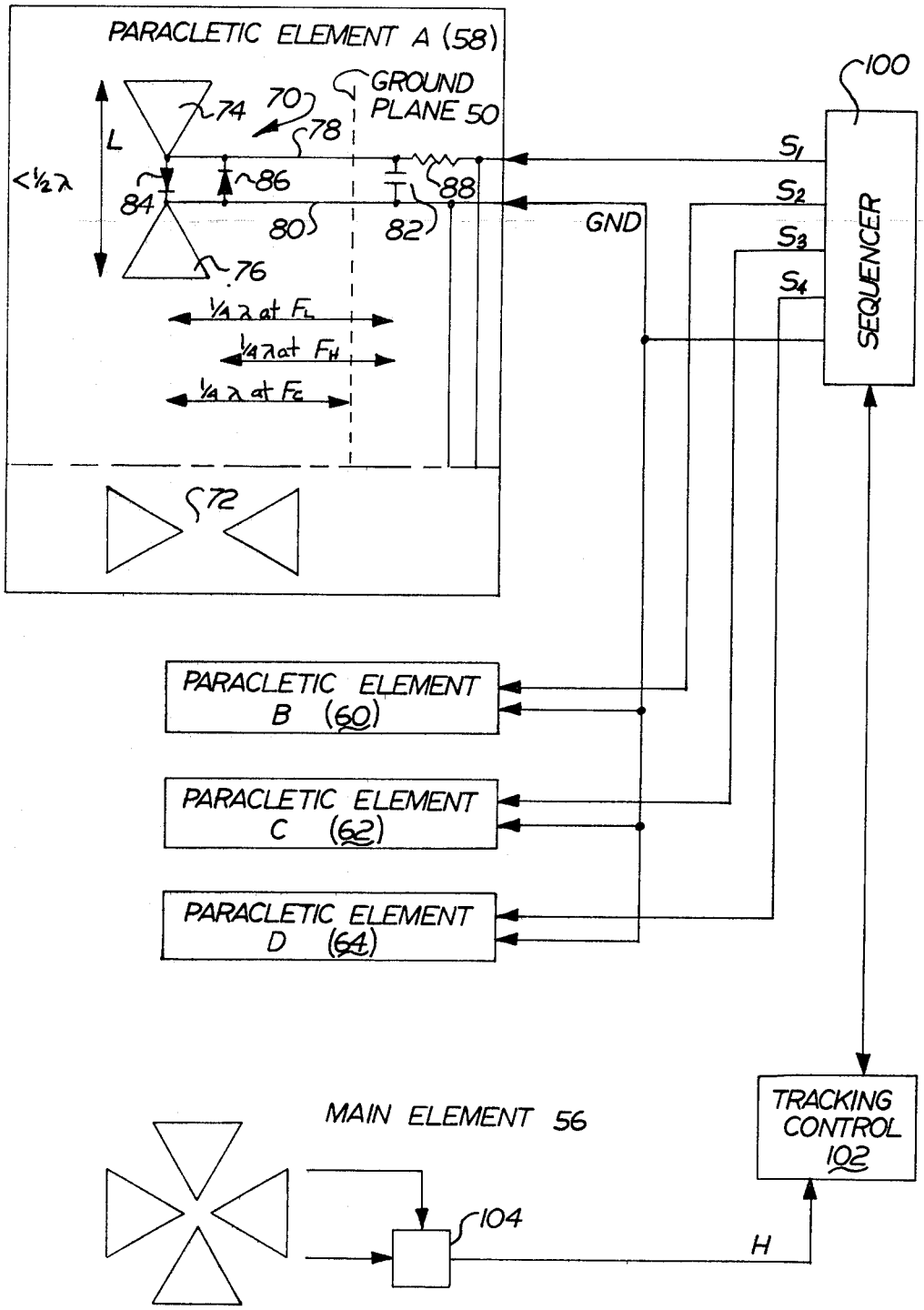
FIG. 5 is a schematic representation of the paracletic elements of the tracking feed illustrated in FIG. 4.

In the embodiment illustrated in FIG. 5, the paracletic element 58 is configured to operate in two frequency bands. Diode 84 is spaced apart from capacitor 82 by a distance corresponding to one quarter wavelength at the center frequency ($F_L$) of the low frequency band. The second diode 86, however, is separated from the capacitor 82 by a distance corresponding to one quarter wavelength at the center frequency ($F_H$) of the high frequency band. By selecting the diode which is to be forward biased, the shorting position along the support members 78 and 80 may be varied as a function of the frequency band being used. This causes the reactance of the paracletic element to be modified so as to compensate for the charge in reactance which would otherwise occur due to the change in operation frequency. This has the effect of equalizing the error modulation slopes for the two frequency bands.

Since the two diodes 84 and 86 are connected back to back, the one of the two diodes which is to be "on" (forward biased) may be selected by selecting the polarity of the bias voltage. If a positive bias voltage is applied to bias line $S_1$, then diode 84 will be forward biased and arms 74 and 76 will be shorted at the position of diode 84. If a negative bias voltage is applied to bias line $S_1$, however, then diode 86 will instead be forward biased, and the shorting will take place at this position of diode 86.

Paracletic elements 60, 62, and 64 are constructed identically to paracletic element 58, and each includes a corresponding diode bias control line $S_2$, $S_3$, and $S_4$. These diode bias control lines, together with the ground line are connected to a sequencer 100 which controls the bias voltage as applied to the paracletic elements in such a manner as to cause the phase center to rotate around the main element 56. The states of the paracletic elements for a particular phase center movement is indicated in the following table:

TABLE III

| PARALLETIC ELEMENT | PHASE CENTER MOVEMENT | | | |
|---|---|---|---|---|
| | LEFT(L) | UP(U) | RIGHT(R) | DOWN(D) |
| A | ON | ON | OFF | OFF |
| B | OFF | ON | ON | OFF |
| C | OFF | OFF | ON | ON |
| D | ON | OFF | OFF | ON |

A tracking control circuit 102 is provided which responds to the synchronizing signals supplied by sequencer 100 and also to the modulated signal supplied by the main element 56 in order to derive tracking information therefrom. This tracking information is then utilized to control the motion of the antenna dish via servo motors associated with the antenna pedestal (not shown).

Figure 6:
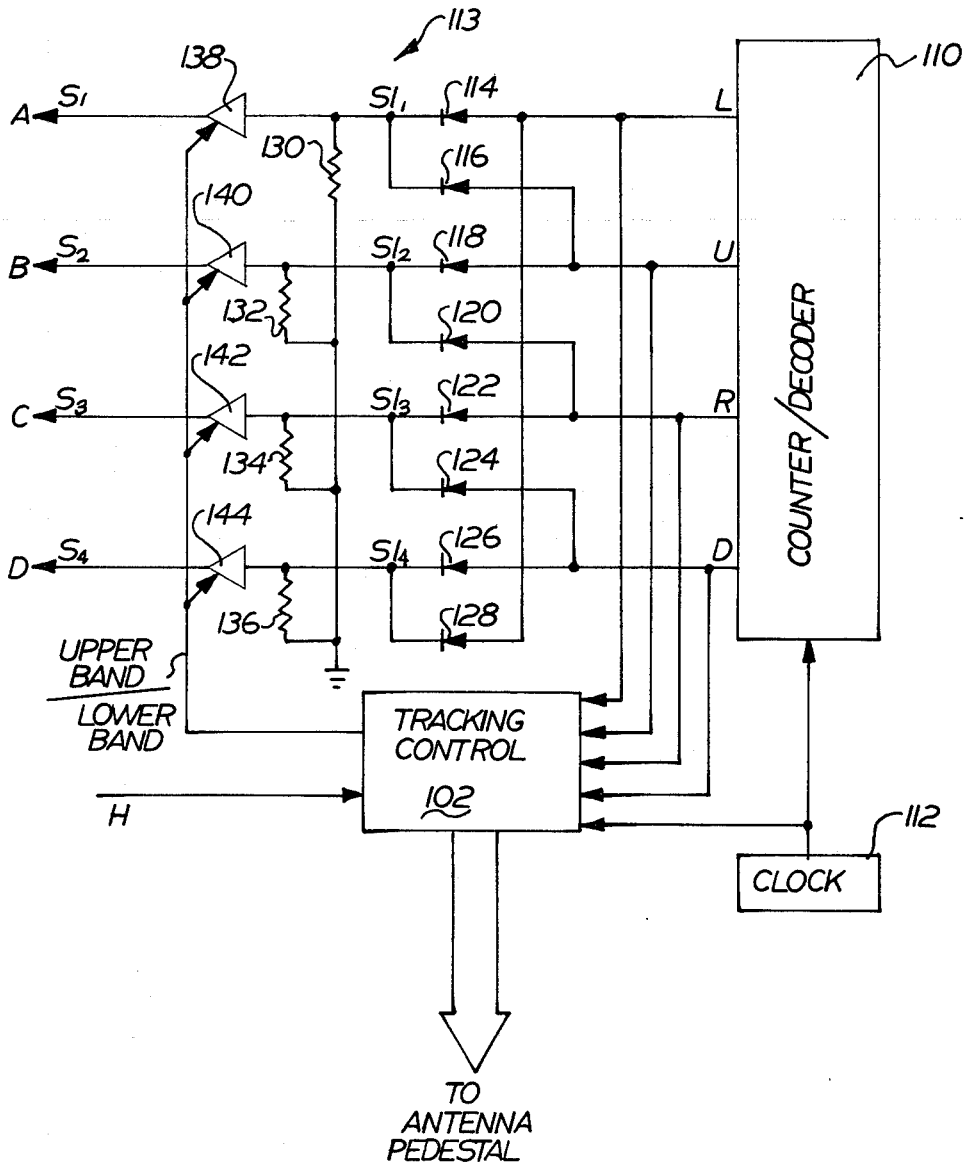
FIG. 6 is a schematic illustration of the scanning circuitry which may be utilized with a tracking feed as illustrated in FIGS. 4 and 5.

As can be seen in FIG. 6, the main element 56 no longer requires a directional coupler, but can instead include merely a 90° phase shift network 104, used for combining the signals supplied by the respective dipole components of main element 56 with a 90° phase shift therebetween, presuming that circularly polarized electromagnetic energy is being utilized.

There is illustrated in FIG. 6 one possible embodiment of the sequencer 100, shown generally in FIG. 5. This circuit includes a counter-decoder circuit 110, which is clocked by a clock circuit 112. Counter-decoder circuit 110 includes a two-bit counter circuit with its outputs connected to a one-of-four decoder circuit. The outputs of the one-of-four decoder circuit represent the outputs of counter-decoder circuit 110. Only one of these four outputs will be at a high logic level at any given time, with the remaining three inputs being at a low logic level. With each clock pulse, the counter will increment by one, causing the output of counter/decoder circuit 110 which is high to shift low, and the next sequential output to shift to a high logic level. A high logic level signal will therefore be presented upon the outputs in the following sequence: L, U, R, D, L, U, R, D, L, etc.

These four outputs control the position of the phase center of the tracking feed. In other words, when the L (Left) output is at a high logic level, then the phase center will be to left of center, as viewed in FIG. 4. Similarly, the phase center will be above the main radiating element 56 when the U (Up) output is high, will be to the right of the main radiating element 56 when the R (Right) output is high, and will be below the main radiating element 56 when the D (Down) output is high. The sequencing of the counter-decoder 110 will thus cause the phase center to rotate around the main receiving element 56 in a clockwise direction (as viewed in FIG. 4).

From table 3, it will be recalled that at any given time two of the paracletic elements are in the "on" state, whereas the remaining two are in the "off" state. Consequently, the signals supplied by the counter-decoder circuit 110 must be matrixed in order to in each case switch on the appropriate two paracletic elements. A diode matrix 113, comprised of diodes 114–128 is provided for this purpose. The relationship between the inputs and outputs of this diode matrix are as follows:

TABLE IV

| DIODE MATRIX 113 | | | | | | | |
|---|---|---|---|---|---|---|---|
| INPUTS | | | | OUTPUT | | | |
| L | U | R | D | $SI_1$ | $SI_2$ | $SI_3$ | $SI_4$ |
| 1 | 0 | 0 | 0 | 1 | 0 | 0 | 1 |
| 0 | 1 | 0 | 0 | 1 | 1 | 0 | 0 |
| 0 | 0 | 1 | 0 | 0 | 1 | 1 | 0 |
| 0 | 0 | 0 | 1 | 0 | 0 | 1 | 1 |

A series of resistors 130, 132, 134, and 136 are provided at the output of the diode matrix in order to pull down the output when the respective diodes are reverse biased.

The outputs of the diode matrix are connected to the paracletic element bias control lines via driver circuits 138, 140, 142, and 144. The magnitude of the output voltages provided by these driver circuits are controlled by the outputs from diode matrix 113, whereas the polarity of the control voltage is determined by an upper-band/lower-band control signal supplied to the drivers by tracking control circuit 102. If the antenna is being operated in the upper frequency band, then this control signal supplied by tracking control circuit 102 will cause the driver circuits 138–144 to switch between a zero voltage level (when the paracletic element is to be in an "off" state) and a negative voltage level (when the paracletic element is to be in an on state). Shorting diodes 86 will thus be used in this event. When the antenna is being operated in the lower frequency band, however, these driver circuits will switch between a zero output voltage (when the corresponding paracletic element is to be in an "off" state), and a positive voltage level (when the corresponding paracletic element is to be in an "on" state). Shorting diodes 84 will thus be used in this event. The operation of this sequencer circuitry therefore provides the correct switching of the paracletic elements, whether the upper or lower frequency band is being utilized.

As stated previously, the outputs of the counter-decoder circuit 110 and the clock circuit 112 are supplied to the tracking control circuit 102 so that synchronous decoding of the modulated signal received from the main element 56 may be accomplished. Tracking control information is thus derived by the tracking control circuit 102 for use in controlling the servo motors associated with the antenna pedastal (not shown).

The embodiment which has been described heretofore with respect to FIGS. 4–6 works well in systems wherein the frequency of operation is below approximately 6 Gc. Difficulties are encountered, however, in utilizing paracletic elements of the described form with the horn antennas usually used for higher frequencies.

Horn antennas are commonly used in the feeds of tracking antennas operating above approximately 6 Gc. The phase centers of these antennas are almost always located just within the aperture of the horn antenna. It is desirable to locate the paracletic elements near the phase center (relative to the wavelengths of the signal being transmitted or received), which in this case means within the aperture of the horn antenna. Unfortunately, if the paracletic elements illustrated in FIGS. 4–6 were mounted within the aperture of a conventional horn antenna, the support rods and biasing elements would also be within the aperture and would interact with the feed pattern in an undesirable way. Moreover, there are difficulties in scaling down the paracletic elements heretofore described to the dimensions desired for operation at short wavelengths. It is therefore desirable to provide a different type of paracletic element for use with feed horns for frequencies above approximately 5 or 6 Gc.

Figure 7:
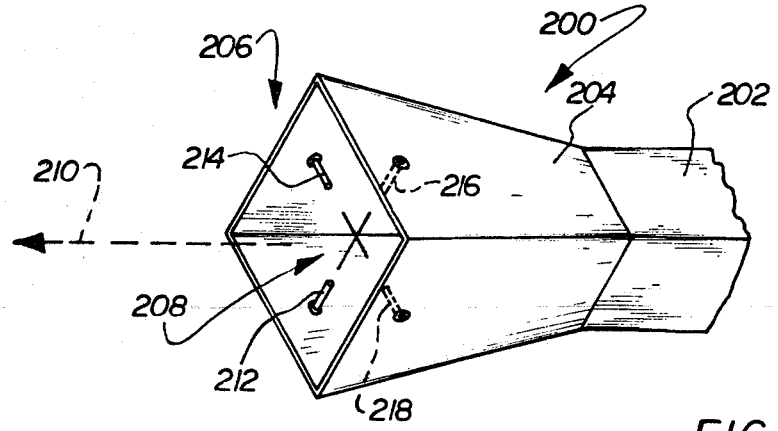
FIG. 7 is a perspective illustration of a horn antenna in accordance with the teachings of the present invention.
Figure 8:
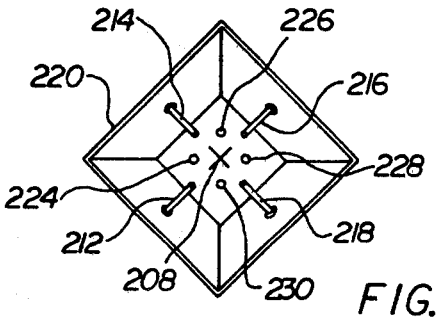
FIG. 8 is a front elevation view of the horn antenna of FIG. 7.

FIGS. 7 and 8 are, respectively, perspective and front elevation views of a horn antenna including paracletic elements to permit electrical positioning and movement of the phase center thereof. The feed antenna with which the paracletic elements are combined is shown in these Figures and in the Figures which follow as having a square cross section. It will be appreciated, however, that the concepts described hereinafter can easily be used in conjunction with feed horns having other cross sectional shapes, such as circular, rectangular, etc.

As can best be seen in FIG. 7, the feed horn 200 includes a waveguide section 202 for channelling electromagnetic energy to and/or from the feed, and a flared section 204 which provides a transition between the waveguide 202 and free space. The phase center 208 of the antenna is indicated by the X located at the center of, and just within, the aperture 206 of the flared section 204. This antenna 200 has a highly unidirectional pattern whose shape is largely determined by the geometry of the flared section 204 of the feed horn. The antenna has a boresight 210 representing the axis of symmetry of the unidirectional pattern. In the embodiment being described herein, the horn 200 is circularly polarized.

In accordance with the teachings of the present invention, paracletic elements are provided for electromagnetically interacting with the pattern produced by the antenna so as to shift its phase center without substantially affecting its amplitude distribution.

In the embodiments illustrated in FIGS. 7 and 8, four paracletic elements are included, each comprising a rod-like probe extending from a corresponding side wall of the flared section 204 of the antenna 200, and oriented substantially normal to the corresponding side wall. The paracletic elements 212, 214, 216 and 218 are all substantially within a common plane perpendicular to the radiating axis 210 and located at a position along the axis coincident with the phase center 208 of the antenna. (In actuality, the paracletic elements 212, 214, 216 and 218 are all slightly skewed relative to this plane since they are normal to the horn walls and the walls are slightly skewed relative to the radiating axis 210 of the antenna.)

The position of the phase center of the antenna 200 may be electrically controlled by controlling the reactance state of the paracletic elements 212, 214, 216 and 218. The manner in which this is accomplished may be more readily understood through reference to FIG. 9, which illustrates one of the paracletic elements 214 extending from its associated side wall 220. The effect of the extended side wall 220 on the electrical characteristics of the element 214 is the same as if a second, identical element were co-linearly disposed at a symmetrical position on the opposite side of the side wall 220. This "image" 222 of the element 214 cooperates with the element 214 to present the appearance of a dipole having essentially twice the effective length of the element 214. As with the embodiments heretofore described with respect to FIGS. 4–6, it is preferable that this total length D1 be somewhat less than half of the wavelength, preferably on the order of 0.35 wavelengths. Consequently, the length D2 of element 214 should be somewhat less than 0.25 wavelengths long, preferable somewhat less than 0.18 wavelengths. The element 214 is then nonparasitic and presents a highly reactive impedance, on the order of several thousand ohms. If the element 214 is shorted to the side wall 220, however, the effect is the same as if the element 214 were shorted to its "image" 222, the result being that the reactive impedance of the element is substantially reduced.

Normally, all of the elements 214, 216, 218 and 220 are electrically isolated from the corresponding side walls, hence all provide quite high reactive impedances. Since they are symmetrically disposed about the phase center 208 of the antenna, however, there is no net effect on the location thereof. If several of these elements (for example, elements 212 and 218) are shorted to their respective side walls, then the phase center will move toward them to the position indicated by reference numeral 224 in FIG. 8. If the paracletic elements 214 and 216 are shorted to their respective side walls, the phase center will move up to the position indicated by reference numeral 226. If the elements 216 and 218 are shorted to their respective side walls, the phase center will move to the position indicated by reference numeral 228, and if the paracletic elements 218 and 212 are shorted to their respective side walls, the phase center will move down to the position indicated by reference numeral 230. By causing the paracletic elements to be shorted to their side walls in the sequence outlined above, the phase center may be made to rotate around the beam axis 20, leading to modulation of the received or transmitted signals.

Since each paracletic element operates as a single dipole, it can affect only one of the two linearly polarized components of a circularly polarized electromagnetic signal. Adjacent paracletic elements are disposed perpendicular to one another, however. Because of this, the shorting of two adjacent paracletic elements to their corresponding side walls results in both linear components of a circularly polarized signal being identically affected, eliminating any detrimental effect to the circularity of the signal.

Figure 9:
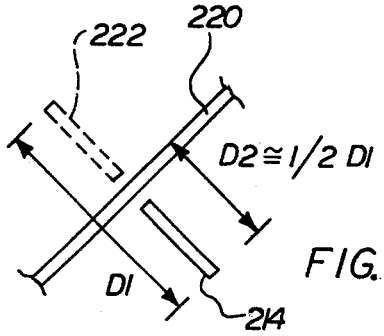
FIG. 9 is a schematic illustration of one of the paracletic elements of the antenna of FIGS. 7 and 8.
Figure 10:
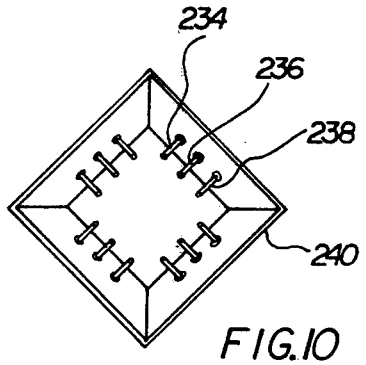
FIG. 10 is a front elevation view of another embodiment of a horn antenna in accordance with the teachings of the present invention.

If a somewhat greater phase center movement is desired than that provided by the embodiments illustrated in FIGS. 7, 8 and 9, the number of paracletic elements protruding from each side of the antenna can be doubled, tripled, etc. FIG. 10 is a front elevation view of an embodiment wherein the number of paracletic elements is tripled. Thus, whereas only a single paracletic element is provided on each face in the embodiments illustrated in FIGS. 7 and 8, in FIGS. 10 and 11 there are three on each face. As in the embodiment of FIGS. 7 and 8, the paracletic elements are again substantially co-planar. The paracletic elements protruding from each side wall of the feed horn are commonly controlled, and are operable in substantially the same fashion as described heretofore with respect to FIGS. 7 and 8.

Figure 11:
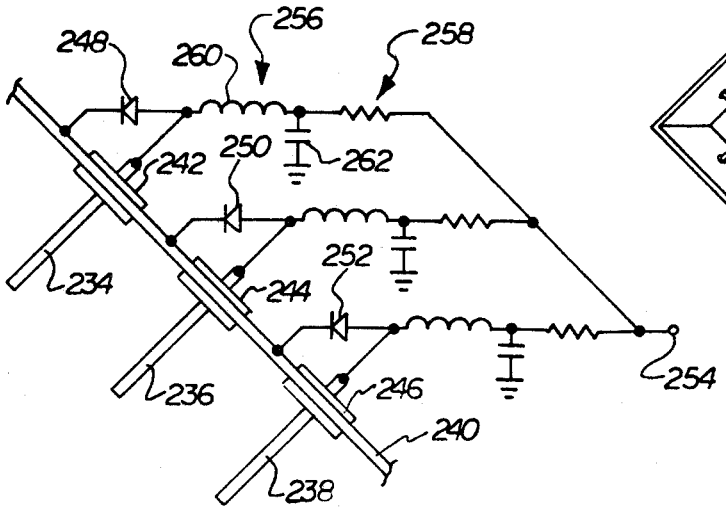
FIG. 11 is a schematic representation of the circuit elements used to change the reactance levels of the paracletic elements of FIGS. 7–10.

The manner in which the paracletic elements are shorted to their corresponding side walls is shown in greater detail in FIG. 11 in reference to the three paracletic elements 234, 236 and 238 which extend from the side wall 240. As seen in this Figure, each of the elements 234–238 is electrically isolated from the side wall 240 by a corresponding annular insulator 242, 244 and 246. The insulators, which are similar to conventional insulating grommets, each have a central opening through which the corresponding paracletic element extends. The outside end of each of the elements 234, 236 and 238 is connected to the side wall through a corresponding diode 248, 250 and 252, however. When a positive voltage is applied to one of these diodes, it is forward biased ("on"), whereby the corresponding one of the elements 234–238 is shorted to the side wall 240. When the applied voltage is at ground potential or below, the diode is "off", whereby the respective element is isolated from the side wall 240, and thus from its "image" appearing at the opposite side of the side wall 240.

Each of the diodes 248–252 is connected to a common bias line 254 through a series combination of a low pass filter 256 and current limiting resistor 258. The low pass filter 256 in each case comprises a series RF choke 260 and shunt capacitor 262. This low pass filter 256 provides a high impedance path for the RF signals appearing on the corresponding paracletic elements 234, 236 and 238, and thus isolates the bias line 254 from this RF energy. When a positive DC signal is applied to the bias line 254 all three diodes are forward biased and thus all three paracletic elements shorted to the side wall. When the bias line 254 is grounded, however, all three diodes are off and thus all three paracletic elements are isolated from the side wall.

Since the bias lines of all of the paracletic elements on a given side will preferably be connected together, as shown in FIG. 11, there are only four bias lines to be controlled; one for each side of the horn. The sequencer shown in FIG. 6 may be used to control the reactance levels of the paracletic elements used in the embodiments shown in FIGS. 7–11. In this case, each of the outputs A, B, C and D of the FIG. 6 sequencer is used to control the bias signal applied to the paracletic elements on one of the side walls of the horn. The phase center of the antenna will then rotate around the axis of its directional pattern, thereby imparting the desired modulation to the received signal.

Antenna tracking feeds have therefore been disclosed wherein the phase center of the tracking feed is caused to rotate about the main receiving element without utilizing mechanical scanning elements. Furthermore, signal matrixing elements such as had been used in the past with conventional pseudomodopulse tracking feeds are also not required.

As stated previously, the invention has broader application to antennas in general, although it is particularly well suited for use as a tracking feed. Thus, although the invention has been described with respect to preferred embodiments, it will be appreciated that various rearrangements and alterations of parts may be made without departing from the spirit and scope of the present invention, as defined in the appended claims.

What is claimed is:

1. A tracking antenna including electromagnetic energy directing means for directing electromagnetic energy to or from a vertex, and a tracking feed located at said vertex, said tracking feed comprising primary radiating/receiving means for receiving or transmitting electromagnetic energy and having a unidirectional radiating pattern, a plurality of paracletic means fixedly positioned about said unidirectional radiating pattern of said primary radiating/receiving means, each having at least two selectable impedance states for controllably shifting the position of the phase center of said tracking feed relative to said directing means, and means for controlling said impedance states of said plurality of paracletic means so as to shift the position of said phase center in a known manner, whereby a signal received by said primary radiating/receiving means is modulated by said controlled phase center shifting and may be processed to derive tracking information therefrom.

2. A tracking antenna as set forth in claim 1 wherein said paracletic means comprise variable reactances switchable between at least first and second reactance value, said switching affecting the position of the phase center of said tracking feed without substantially affecting the amplitude pattern of said antenna.

3. A tracking antenna as set forth in claim 1, wherein each of said paracletic means comprises at least one dipole having two dipole arms joined through a circuit switchable between a first, high impedance state and a second, low impedance state, the state of said circuit being controlled by said control means.

4. A tracking antenna as set forth in claim 1, wherein said control means includes means for controlling said paracletic means so as to cause said phase center to cyclically rotate about said primary receiving/radiating means.

5. A tracking antenna as set forth in claim 1, wherein said directing means comprises a parabolic dish reflector.

6. An antenna comprising main radiating means for receiving or transmitting electromagnetic energy said radiating means having a unidirectional radiating pattern centered about an axis, at least one paracletic element positioned relative to said main radiating means at a location which is spaced apart therefrom both along and transverse to said axis, whereby said at least one element is located generally within said unidirectional pattern but off to one side of said axis, said paracletic element being switchable between at least first and second impedance states affecting the position of the phase center of said antenna with respect to said main radiating means, and control means for controlling the states of said at least one paracletic elements so as to thereby control the location of the phase center of said antenna.

7. An antenna as set forth in claim 6, wherein said paracletic elements are variable reactances switchable between a first reactance value wherein the position of said phase center of said antenna is essentially unaffected by said paracletic elements, and at least one of other reactance value wherein the position of said phase center is shifted without substantially affecting the amplitude pattern of said antenna.

8. An antenna as set forth in claim 6, wherein said paracletic elements each comprise at least one dipole having two dipole arms joined through a circuit switchable between a first, high impedance state and a second, low impedance state, the state of said circuit being controlled by said control means.

9. An antenna as set forth in claim 8, wherein the length of said dipole, measured along said dipole arms, is less than 0.35 times the wavelength of the operating frequency of said antenna.

10. An antenna as set forth in claim 8, wherein said circuit comprises a shorted stub joining said dipole arms, at least one diode for shorting said dipole arms together at said dipole arms, and means for applying a forward or reverse bias voltage across said diode so as to switch said diode into either a low impedance, conductive state, or a high impedance, non-conductive state.

11. An antenna as set forth in claim 6, wherein said main radiating means comprises a pair of orthogonal dipoles having substantially coincident centers, and a ground plane positioned substantially parallel to the plane of said orthogonal dipoles whereby the radiation pattern of said dipoles is substantially perpendicular to said ground plane, and further wherein said paracletic elements comprise a plurality of variable reactances switchable between at least first and second reactance states and positioned about said dipole pair, said variable reactances being structured and positioned so that said reactances interact with said dipole pair to shift the position of the phase center of said antenna when switched between said at least first and second reactance states.

12. Apparatus comprising:

an antenna having a directional amplutude pattern;

non-parasitic reactance means positioned proximal said antenna but offset therefrom in a direction transverse to said directional amplitude pattern for electromagnetically interacting with said antenna to shift its phase center by an amount dependent upon the reactance of said reactance means, said means having a controllable reactance; and control means for controlling the reactance of said non-parasitic reactance means so as to thereby control the location of the phase center of said antenna.

13. Apparatus comprising:

an antenna having a directional amplitude pattern;

non-parasitic reactance element electromagnetically interactive with said antenna and positioned proximal said antenna but offset therefrom in a direction transverse to said directional amplitude pattern, said element being switchable between first and second reactance states differently effecting the location of the phase center of said antenna; and control means for controlling the reactance states of said non-parasitic reactance element so as to thereby control the location of the phase center of said antenna.

14. Apparatus as set forth in claim 13, wherein said non-parasitic reactance element comprises at least one dipole having two dipole arms joined through a circuit switchable between a high impedance state and a low impedance state, the state of said circuit being controlled by said control means.

15. Apparatus as set forth in claim 14, wherein the length of said dipole, measured along said dipole arms, is less than 0.35 times the wavelength of the operating frequency of said antenna.

16. Apparatus as set forth in claim 14, wherein said circuit comprises at least one unidirectional current conducting means electrically joining said dipole arms together, and wherein said control means includes means for applying a forward or reverse bias across said unidirectional current conducting means so as to controllably switch said unidirectional current conducting means into either a low impedance, conductive state, or a high impedance, non-conductive state.

17. Apparatus as set forth in claim 13, wherein said antenna comprises a pair of orthogonal dipoles having substantially coincident centers, and wherein said non-parasitic reactance element is one of a plurality of similar non-parasitic reactance elements positioned circumferentially about said pair in a plane oriented parallel to the plane in which said pair of othogonal dipoles lie.

18. Apparatus as set forth in claim 17, wherein said control means comprises means for controlling the reactance states of said plurality of non-parasitic reactance element so as to cause the phase center of said antenna to move in a predetermined manner.

19. Apparatus as set forth in claim 18 wherein said means for controlling the reactance states of said plurality of non-parasitic reactance elements comprises means for controlling said elements such that the phase center of said antenna effectively rotates around said antenna.

20. Apparatus as set forth in claim 17, wherein each of said plurality of non-parasitic reactance elements comprises a pair of orthogonal dipoles having substantially coincident centers, each dipole having two dipole arms and means responsive to said control means for controllably shorting or not shorting said two dipole arms together.

21. Apparatus comprising electromagnetic energy directing means for focusing electromagnetic energy at a vertex, a feed antenna having a directional amplitude pattern, said feed antenna being disposed at said vertex and pointed so that said energy directing means is disposed within said pattern, non-parasitic reactance means for electromagnetically interacting with said feed antenna to shift its phase center by an amount dependent upon the reactance of said reactance means, said reactance means having a controllable reactance, and control means for controlling the reactance of said reactance means so as to shift the position of said phase center in a known manner, whereby a signal received by said feed antenna is modulated in accordance with said controlled phase center shifting.

22. Apparatus as set forth in claim 21, wherein said non-parasitic reactance means is positioned proximal said feed antenna but offset therefrom in a direction transverse to said directional amplitude pattern.

23. Apparatus as set forth in claim 21, and further comprising a plurality of other non-parasitic reactance means positioned circumferentially about said feed antenna, wherein said control means comprises means for controlling all of said reactance means.

24. Apparatus as set forth in claim 23, wherein said control means comprises means for controlling said plurality of reactance means so as to cause said phase center to rotate around said feed antenna.

25. Apparatus comprising:

a horn antenna comprising an open-ended waveguide having a directional amplitude pattern and a phase center situated inside the open end of said waveguide;

non-parasitic reactance means for influencing the position of said phase center in accordance with the reactance of said reactance means, said means comprising an elongated conductive member extending from a wall of said waveguide toward said phase center in a direction transverse to said directional amplituide pattern; and means for controlling the reactance of said reactance means and thereby the location of the phase center of said horn antenna.

26. Apparatus as set forth in claim 25, wherein said means for controlling the reactance of said reactance means comprises means for controllably shorting said elongated conductive member to said wall of said waveguide.

27. Apparatus as set forth in claim 25, wherein there are plural said elongated conductive members extending from said wall, said plural conductive members being disposed substantially parallel to one another.

28. Apparatus as set forth in claim 27, wherein said means for controlling the reactance of said reactance means comprises means for providing a single control signal for commonly controlling the reactance of all said plural elongated members.

29. Apparatus as set forth in claim 27, wherein said means for controlling the reactance of said reactance means comprises means for controllably shorting said plural elongated members to said side wall.

30. Apparatus as set forth in claim 25 and further comprising a plurality of like non-parasitic reactance means positioned about said phase center in a plane transverse to said directional amplitude pattern.

31. Apparatus as set forth in claim 30, wherein each of said plurality of like non-parasitic reactance means comprises an elongated conductive member extending from an associated side wall of said waveguide, and wherein said reactance control means comprises means for controllably connecting one or more of said reactance means to the associated side wall of said waveguide.

32. Apparatus as set forth in claim 25, and further comprising a second elongated conductive member extending from a side wall of said waveguide in a direction substantially perpendicular to the direction in which the first said elongated conductive member extends whereby said elongated members effect orthogonal polarizations of electromagnetic energy.

* * * * *